United States Patent [19]

Kutt et al.

[11] 4,231,575

[45] Nov. 4, 1980

[54] RACKET STRINGING

[75] Inventors: Mers Kutt, 105 Linda Isle, Newport Beach, Calif. 92660; Bernard Osbaldeston, La Canada, Calif.

[73] Assignee: Mers Kutt, Newport Beach, Calif.

[21] Appl. No.: 863,999

[22] Filed: Dec. 23, 1977

[51] Int. Cl.[3] ..... A63B 51/00; A63B 51/08

[52] U.S. Cl. ..... 273/73 D

[58] Field of Search ..... 273/73 R, 73 C, 73 D, 273/73 E, 73 G, 73 H

[56] References Cited

U.S. PATENT DOCUMENTS

| | | | |
|---|---|---|---|
| 323,608 | 8/1885 | Turner | 273/73 D |
| 455,632 | 7/1891 | Malings | 273/73 D |
| 644,877 | 3/1900 | Slazenger | 273/73 D |
| 801,246 | 10/1905 | Johnson | 273/73 D |
| 971,773 | 10/1910 | Mueller | 273/73 D |
| 1,132,214 | 3/1915 | Ries et al. | 273/73 D |
| 1,173,712 | 2/1916 | DuBois | 273/73 D |
| 1,292,317 | 1/1919 | Holding | 273/73 D |
| 1,531,778 | 3/1925 | Gallaudet | 273/73 D |
| 1,531,862 | 3/1925 | Larned | 273/73 D |
| 1,532,703 | 4/1925 | Larned | 273/73 D |
| 1,609,662 | 12/1926 | Rawlings et al. | 273/73 D |
| 1,624,720 | 4/1927 | Dritz | 273/73 D |
| 1,695,595 | 12/1928 | Larned | 273/73 D |
| 1,733,960 | 10/1929 | Godfrey | 273/73 D |
| 2,059,917 | 11/1936 | Spencer | 273/73 D |
| 2,401,291 | 5/1946 | Smith | 273/73 D |
| 2,542,661 | 2/1951 | Godfrey | 273/73 D |
| 2,626,804 | 1/1953 | Robinson | 273/73 D X |
| 2,878,020 | 3/1959 | Robinson | 273/73 D X |
| 3,239,224 | 3/1966 | Finn et al. | 273/73 D X |
| 3,545,756 | 12/1970 | Nash | 273/73 D X |
| 3,738,096 | 6/1973 | Crandall | 273/73 D X |
| 3,820,785 | 6/1974 | Occhipinti | 273/73 D X |
| 3,834,699 | 9/1974 | Pass | 273/73 D |
| 4,013,289 | 3/1977 | Kaminstein | 273/73 D |
| 4,016,714 | 4/1977 | Crandall et al. | 273/73 D X |
| 4,026,553 | 5/1977 | Vendramini | 273/73 D X |
| 4,093,220 | 6/1978 | Prewarski | 273/73 D |

FOREIGN PATENT DOCUMENTS

| | | | |
|---|---|---|---|
| 402899 | 9/1909 | France | 273/73 D |
| 413753 | 6/1910 | France | 273/73 D |
| 901279 | 10/1944 | France | 273/73 D |
| 5248 | of 1880 | United Kingdom | 273/73 D |
| 1314 | of 1884 | United Kingdom | 273/73 D |
| 300700 | 11/1928 | United Kingdom | 273/73 D |

*Primary Examiner*—Richard J. Apley

*Attorney, Agent, or Firm*—Seymour A. Scholnick

[57] ABSTRACT

Strung rackets for hitting compressible balls have a stringing network that can be adapted to provide for an expanded sweetspot; precise diminution of dead spots especially at the top of the racket; reduced string wear; controllable areal stiffness for hard hitting; prolonged dwell time of the ball on the racket for directional control of the ball; and increased frictional contact between ball and racket for improved stroking, and application and control of spin to the ball. The rackets employ predetermined patterns and concentrations of string in predetermined areas within the racket frame to provide stringing networks complemental and functional to the particular characteristics of an individual player. Downwardly flared string crossings and multiple strand reentrant string crossings are used alone and in combination to provide the predetermined patterns and concentrations. The multiple strand reentrant string crossing structures include parallel, anti-parallel, and double or triple spiraling strands formed by reentering strings in multiple traverses across the frame through the same pair of opposed frame holes.

11 Claims, 14 Drawing Figures

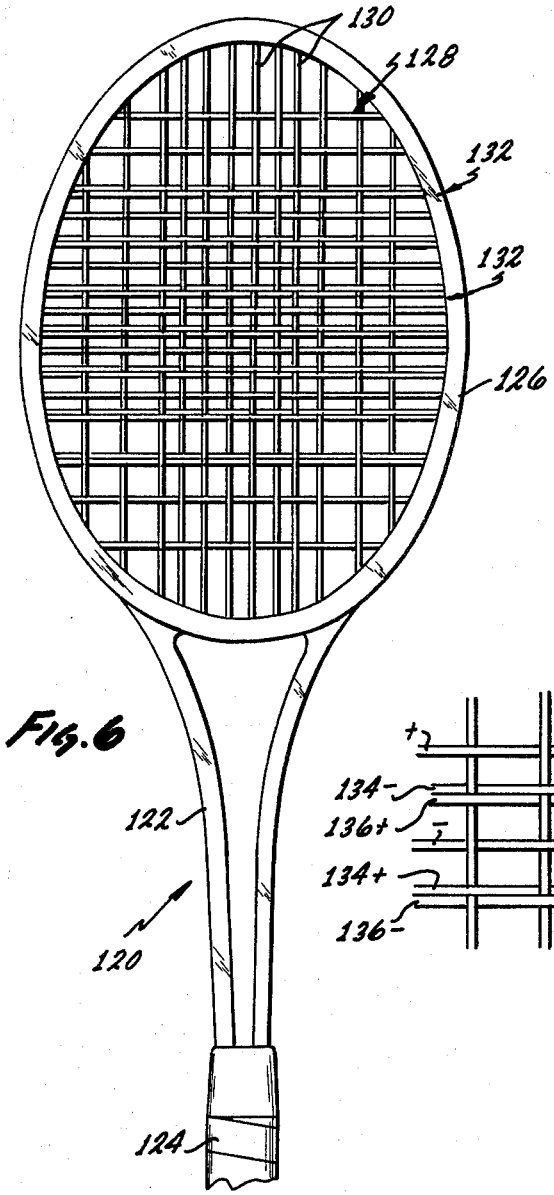
Fig. 6
Fig. 8
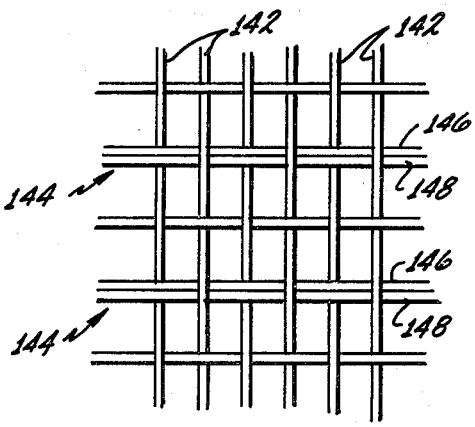
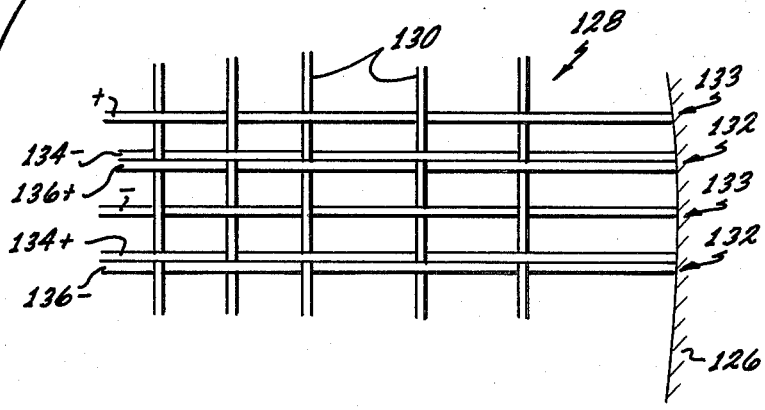
Fig. 7a
Fig. 7b
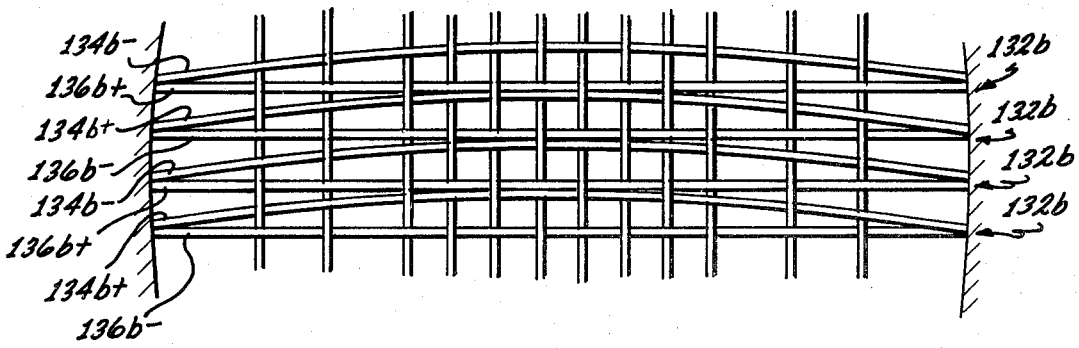

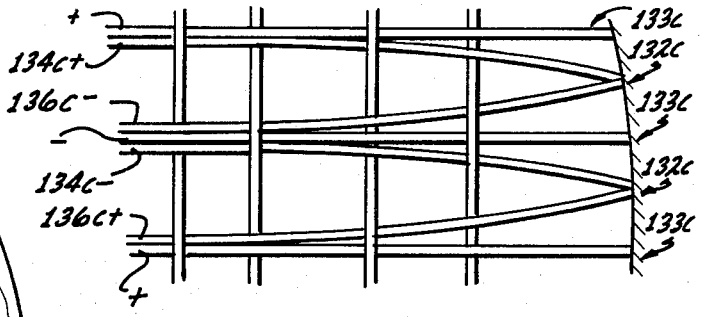
FIG. 7C
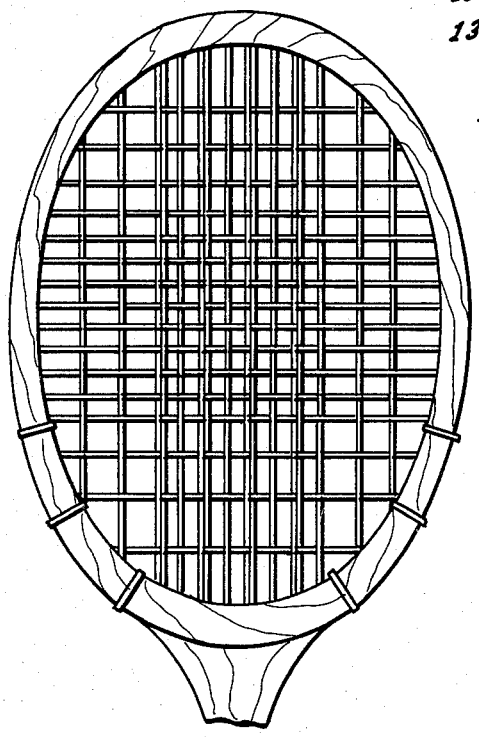
FIG. 9b
FIG. 9a
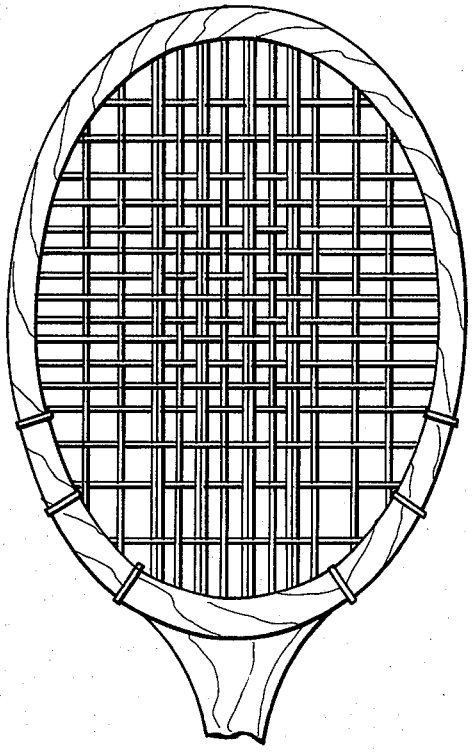
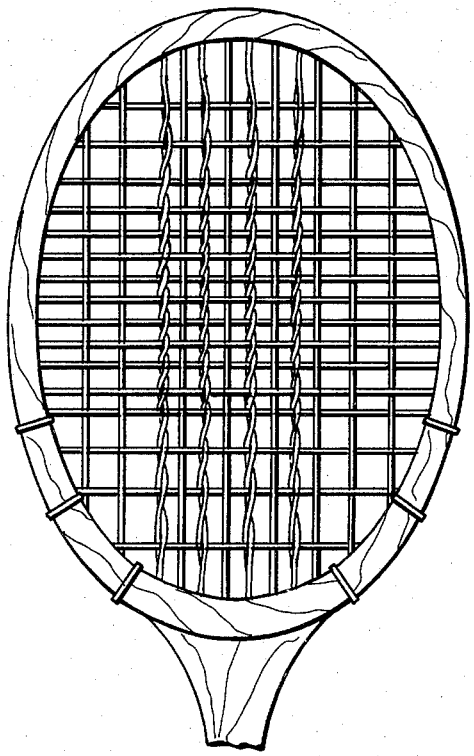
FIG. 9c

RACKET STRINGING

BACKGROUND OF THE INVENTION

1. Field of the Invention

The present invention relates to strung rackets for hitting compressible balls, and more particularly relates to stringing networks in tennis rackets for stroking balls more effectively.

2. Description of the Prior Art

In the sport of tennis, a ball is hit from one side of the court to the other, the sides being separated by a net. The ball is usually a compressible ball covered by a fabric or fabric-like outside surface. The ball is stroked by a racket which comprises a handle connected through the neck of the racket to a stringing frame, which is usually oval or elliptical in shape. Many other shapes, however, such as circular frames, rhomboidal frames, pear-shaped frames, etc. have been employed at various times during the last 100 years. (See U.S. Pat. No. 2,059,917 to Spencer.)

The area within the closed or substantially closed stringing frame is strung with gut, nylon or similar string capable of having a very high tension. It has been customary to string the entire area within the racket frame with a single gut or string, which is threaded through holes in the frame and woven through and around the other string portions of the stringing network which are encountered during each traverse across the frame. The most common form of stringing within the frame includes a series of spaced vertical string traverses or string crossings, crossing from the top of the frame to the bottom or neck of the frame, and a plurality of spaced horizontal string crossings crossing transversely from one side of the racket frame to the opposite side of the racket frame. The entire stringing may be called a network or a stringing network.

In this application, the term "string" will at times, which will be clear from context, be used as a shortened form of the term "string crossing", to denote a string crossing from one side of the racket frame to the oppositely disposed side of the racket frame. The term "string" when so used should not be understood to indicate a separate, individual string, since, as noted above, the entire stringing network is frequently strung with a single string. Rather, when so used, the term "string" should indicate only a string crossing as defined.

In stringing a racket, the string is pulled taut, to provide a predetermined tension commensurate with the strength of the frame. Very expensive and exotic materials, such as graphite or boron fibered plastics or fiberglass, have been used for the frame, and often times for the entire racket in an effort to limit weight and yet increase the strength of the frame enough to support very high tensions as required in conventional rackets for very hard hitting.

The network is ordinarily threaded so that each transverse string crossing is woven first on top and then underneath successive vertical strings which are crossed in the stringing process. Conventionally, it has been customary to have the spacing between adjacent parallel strings, either in the vertical or in the transverse directions, equal so as to provide a uniform appearing surface throughout the stringing network area within the frame. In such conventional stringing, the parallel equi-spaced horizontal strings are not extended into the very top and bottom areas of the racket.

The appearance and dimensioning of a conventionally strung tennis racket is shown and described in U.S. Pat. No. 4,013,289 and can be considered to comprise a network of 18 vertical (main) strings and approximately 20 horizontal (cross) strings interwoven at substantially 7/16" spacings to form substantially 7/16" squares.

A conventionally strung tennis racket has very serious deficiencies. Such a racket has a rather small "sweetspot." The sweetspot is that area of the stringing network, usually centered just below the center of the frame, which will give very good response when the ball is impacted thereon. It is the area of the racket face at which players report that the shot "feels good" when the ball is hit there. When the ball is hit in the sweetspot area, the player perceives little or no jolt of the racket as he hits the ball and follows through to complete the stroke. The sensation is of a continuous stroke in which the racket and the ball join for a time and then the ball is eventually allowed to depart from the racket at a time and direction which appears to the player to be very controllable and predictable. Moreover, when the ball is hit on the sweetspot, the perception of the player is often that he has ample time and control to apply any desired type of spin, as for example, top spin or slice, etc., which have such important strategic significance in tennis. In a conventional tennis racket, all of the good features of hitting on the sweetspot drop off dramatically as the ball is hit away from the sweetspot. Jar is increased, control and predictability of ball direction are increasingly diminished, and the ability to apply controllable spin is increasingly diminished. These deficiencies, as you hit away from the sweetspot, are expecially severe as the point of impact moves upwards towards the top of the racket and culminates in a large "dead spot" at the top of the racket. If the ball is hit near the top-of-the-racket dead spot, it feels very much like you have hit the racket with a wooden board rather than with a set of strings and power and velocity and directionality are lost. This top-of-the-racket dead spot causes especially severe difficulties in the tennis serve, and in part accounts for the enormous differences in the ability of champion players and just ordinary good players to deliver a powerful tennis serve. The very best tennis players hit the serve very close to the sweetspot. All other players tend to hit the ball in the serve well above the sweetspot and even into the margins of the top-of-the-racket dead spot, thus creating enormous differences in the effectiveness of serving.

There are other very serious disadvantages of the conventionally strung racket. If very high hitting power is desired, the tennis racket will be strung to a very high tension to increase the "stiffness" of the stringing network. However, only very good tennis players can use a really tightly strung racket because there is a tendency for a very rapid rebound of the ball from the racket, and therefore decrease of dwell time of the ball on the racket and hence loss of directionality and control, unless the player is very skilled in applying his stroke. A very good tennis player not only "follows through" on his stroke but actually accelerates the racket head in a very predetermined manner during the driving portion of the stroke in order to keep the racket in contact with the ball throughout such period of the stroke and thereby increases directionality and control as the ball adopts the direction in which the racket is moved. (Without such prolonged contact between racket and ball, the direction of rebound of the ball tends to be more determined by the laws of mirror reflection from the plane surface of the racket.) Thus, a very good player can compensate for the loss of directionality and control which is inherent in a very tightly strung racket. Even a very good player, however, pays a price for a very tightly strung racket because (1) very strong and expensive frames must be used to support the high string tensions, (2) the high string tension reduces string life, (3) the racket tends to be very unforgiving when the player makes an occasional poor or even marginal shot, and (4) the attention required for control of a very highly strung racket is a drain upon the attention that might otherwise be available for such high level and very important matters as anticipation of the opponent, footwork, and general court strategy.

Most players who are not truly expert, find that they can play best with a "softer," lower-tension, more forgiving stringing which has a somewhat larger sweetspot which will give them inherently lower hitting power but greater controllability and directionality and predictability. But such a compromise also has its prices. If power is lower at the sweetspot, it will tend to be very much lower off the sweetspot, so that the average player tends to make many weak returns. The top-of-the-racket dead spot remains as a dangerous hazard in serving. String life is reduced by another mechanism, by increasing sawing of the strings upon each other due to their relative looseness and movability when the ball is impacted. Also, the sweetspot although somewhat enlarged remains still quite small, with great loss of power, control, predictability, etc., as the less skilled, average player hits frequently off the sweetspot throughout play.

In addition, all tennis rackets, whether tightly strung or more softly strung, have very serious limitations in their ability to apply and control spin to the ball because of the low frictional contact between the ball and the strings as well as the limited dwell time of the ball on the racket.

There have been many prior art nonconventional tennis racket stringings that have been utilized in attempt to remedy some of the above-described deficiencies of the conventional racket. In general, these prior art nonconventional stringings are somewhat irrational and reflect an incomplete or even incorrect understanding of the determining factors of string performance. Thus, for example, one prior art racket (U.S. Pat. No. 323,608) has extra horizontal cross strings across the top to supposedly strengthen and reinforce the dead spot at the top of the racket. However, as will be later explained, such horizontal tennis strings at the top of the racket, because of their extreme shortness, would be expected to contribute to deadness at the top of the racket rather than to eliminate deadness at that point.

Another prior art approach with a somewhat atypical or unconventional stringing pattern is described in the U.S. Pat. No. 4,013,289, by Kaminstein, which purports to enlarge the sweetspot of a conventional racket by decreasing the number of strings at the margin of the racket. The approach of the Kaminstein device is rational though incomplete. It does provide some of the features which would be obtained from an enlarged sweetspot. Because of the moderate trampolining effect of this stringing, the ball can more readily stay in contact longer with the central areas of the racket and will, when propelled from the racket by the rebounding strings, depart in softly hit returns with greater power from the racket than would be otherwise obtained. However, as with all trampolining systems, there are also substantial difficulties. If the racket stringing is soft, the trampolining effect may be excessive, making the time and velocity of departure of the ball unpredictable. If the stringing is tight, because of the reduced number of strings (relative to the conventional racket) at the margins of the racket, very large forces will be applied to these strings if the ball hits at the margin, and they may break or respond in an erratic manner. The severe dead spot at the top of the racket remains. Also, at the sides of the racket, because of the reduced number of vertical strings that will make contact with the ball if the ball is hit at either side, both directionality and friction is impaired, thus reducing the ability to control direction and spin of a marginally hit ball. Thus the Kaminstein device is viewed as a generally rational but incomplete approach to the solution of the problems described above.

What is desired is to provide a tennis racket that has a stringing network that meat can be adapted to give a greatly enlarged sweetspot, precise diminution of dead spots, especially at the top of the racket, reduced string wear, controllable areal stiffness for hard hitting, prolonged dwell time of the ball on the racket, and increased frictional contact between ball and racket for improved application and control of spin to the ball.

SUMMARY OF THE INVENTION

Briefly, according to the present invention, the above-sought advantages are obtained through precise and coordinated use of string concentrations within the racket frame, and particularly through the use of downwardly flared string crossings and multiple strand string crossings which are used alone and in combination to provide predetermined patterns and concentrations of strings within the racket frame to provide the above-described advantages. The downwardly flared string crossings and the multiple strand string crossings are also, in some embodiments, used in combination with the structures similar to those used in the Kaminstein device and provide very significant improvements to that general type of system.

As a particular example, the problem of the dead spot at the top of the racket is approached by using downwardly flared string crossings which provide a higher concentration or closer spacing of long strings at the top of the racket than is provided in a conventional racket, thereby increasing the stiffness and strength of the racket in the top area and relieving the deadness which otherwise characterizes the top area of the racket. Also the downwardly flaring strings can have a concentration at the racket center which still gives hard hitting there and can have a reduced concentration below center which enables use for softer hitting as in lobs and drop shots.

According to the invention, similar results with respect to remedying the dead spot at the top of the racket are obtained by use of another form of top area string concentration, using either multiple reentrant strand main strings which thus provide more long strings at the top of the racket, (or by the use of multiple strand horizontal strings in that area in a softer strung racket). As previously indicated, the multiple strand string crossings may be provided as parallel adjacent strands or antiparallel strands or even spirally wound-about-each-other strands.

More generally, the same approaches and techniques of selective string concentration are used to solve the more basic and general problems of providing greatly enlarged sweetspot, precise reduction of dead spots, avoidance or reinforcement of low string concentration areas, and increased friction between ball and racket for better spin application. The same approaches and techniques also allow markedly reduced string wear, both through reduction of string tension and through "locking" of the strings with respect to each other so as to decrease or eliminate sawing action.

In the embodiments of the invention which will be described in the present application, it will become apparent how this set of string concentration techniques is used in a coordinated manner to provide systems which simultaneously solve large numbers of these apparently unrelated problems.

The reason that such large numbers of apparently unrelated problems can be solved by a single set of string concentration techniques is that these various problems are subtly interrelated to each other in a manner which is not generally understood, thus accounting for the many largely irrational or uncoordinated prior art approaches.

It is worthwhile, for purposes of greater understanding and insight, to briefly discuss the analysis of these problems which has been made by the present applicant and from which he has been able to develop the coordinated solutions of the present invention. Before one can understand what contributes to a sweetspot, one has to understand what makes a dead spot in the stringing network. Compared to strings, the racket frame is very dead. It has very little liveliness, very limited deflections and resiliency. The strings are connected to the frame; they traverse across the frame and pass through holes in the frame. The degree of deadness of any spot on a string is closely related to the degree of coupling which that spot has to the frame. A number of factors determine the coupling of a string and of spots on the string to the frame. If the string is fairly long, spots on the string near the center of the string will be fairly well decoupled from the frame by the long lengths of string in both directions and will have great liveliness and resiliency. In fact, all spots along the length of a long string will be more decoupled from the frame than corresponding spots on a short string.

It is believed, as a more quantitative evaluation, that the degree of decoupling from the frame of a spot on a string will be roughly proportional to the product of its two string distances to the frame. In a gross sort of way then, a short string is much more closely coupled to the frame than a long string, and a short string will be much deader along its length than a corresponding tensioned long string.

The coupling of a string to the frame is also greatly increased by high tension of the string, which places the ends of the string in extremely intimate and locked contact with the frame. Moreover, the effect of string tension in promoting close coupling to the frame is nonlinear and rises very rapidly with high string tensions. Thus if one really wants to create a dead spot at a stated area within the frame, one simply uses very high stringing tensions and traverse that area with quite short strings. This results in a very fine dead spot such as normally exists at the top area of a racket and, to a certain extent, at the sides and, to a more limited extent, at the bottom. The difference in emphasis respect to top and bottom dead spot areas results because of the modification thereon introduced by the varying responsiveness of the frame itself which characteristically has its own dead spot at the top of the racket.

Having understood what causes a dead spot, we can now proceed to clearly understand what contributes to the operation of the sweetspot. The sweetspot is centered near the center of the racket because all strings traversing through the center are long and because that area maximizes the string lengths from that point to the frame. Because of the large amount of decoupling contributed by the long string lengths, the sweetspot will continue to function in the central area even though the stringing is made extremely tight (although in such usage, the sweetspot will be reduced in area).

Thus a very good player can obtain high power with great control by hitting the ball very accurately in the central sweetspot area of a very tightly strung racket, provided that the good player also properly accelerates his racket frame during his stroke so as to prolong the dwell time of the ball on the racket face, which is the factor that primarily determines directional control of a ball, by conforming ball direction to the direction in which the racket is moved. A less formidable player does not have this array of skills and requires a more softly strung racket with larger sweetspot and more forgiving characteristics and should be prepared to pay the price in lower power. A trampoline system such as the Kaminstein system provides a partial compromise solution, but because of the reduced string density at the margins, causes other problems of unpredictable string response (because the strings no longer look like a surface to the ball) and because of the excessive stresses exerted on the marginal strings if they are impacted by the ball.

It is therefore possible now to better understand the coordinated functioning of the features of the present invention. If one provides concentrations of long strings at the areas where strength and power are actually required in real tennis play, then it is possible to reduce overall stringing tension from the inordinate values (60–80 pounds per square inch), sometimes used by champion tennis players, and get greatly decreased coupling to the "dead" frame while still maintaining very high power and strength in those areas. As indicated, such precisely selected string concentrations can be obtained by combinations of string concentrations provided by downward flaring, long strings and use of multiple strand strings. Moreover, strings at the margin of the racket can also be selectively reinforced with the same type of selectively applied long string concentrations. Also, if required, even quite short marginal strings will operate better if provided, for example, as multiple strand reentrant strings at lower string tension levels.

In such arrangements, longer dwell time of the ball on the racket is more automatically provided by the enlarged sweetspot area; string life is preserved by the decreased tension and by the locking action of several types of string concentrations which tend to lock crossing strings relative to each other so as to decrease sawing action. In addition, the string concentrations, especially the multiple strand strings, provide greatly increased frictional contact with the balls for greater spin control. This is especially true with the spirally wound form of multiple strand strings.

BRIEF DESCRIPTION OF THE DRAWINGS

FIG. 6 is a plan view of another embodiment employing multiple strand reentrant cross stringings;

FIG. 7A is an expanded detail of a portion of the view of FIG. 6 as seen within the boundary of the insert;

FIG. 7B illustrates yet another type of multiple strand string crossing;

FIG. 7C illustrates another variation of multiple strand string crossings;

FIG. 8 is an expanded detail of yet another embodiment of multiple strand reentrant string crossings in a stringing network; and FIGS. 9A, 9B and 9C are expanded details of yet other embodiments of the present invention, illustrating several types of multiple strand reentrant vertical stringings.

DESCRIPTION OF THE PREFERRED EMBODIMENT

Figure 1:
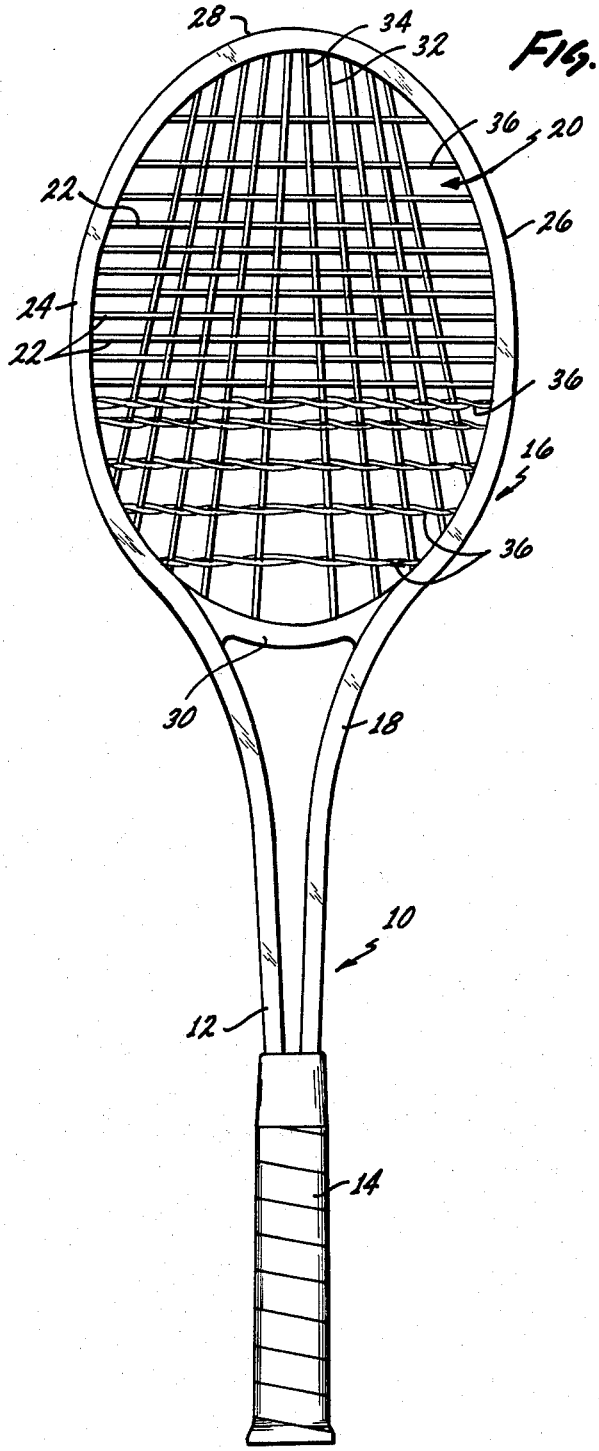
FIG. 1 illustrates a preferred embodiment of the invention having downward flaring main strings and selected multiple reentrant strand cross strings.

FIG. 1 is a plan view illustrating a racket having a stringing network in accordance with the preferred embodiment of the present invention. In particular, a racket 10 is shown having a handle 12 and a hand grip 14 and an oval stringing frame 16 connected to the handle 12 through a neck area or neck 18.

The frame 16 comprises a closed annulus defining a closed area therewithin. In the closed area, a stringing network 20 is installed. The stringing network may preferably comprise a single string forming the various string crossings as shown. Less preferably it may comprise a small plurality of strings having individual beginnings and ends, all in accordance with the desires of the stringer. More particularly, the use of a single string is preferred in the initial stringing of a racket in accordance with the invention, while the use of one or a few additional strings is contemplated and will be advantageous for modifying and adjusting an already strung racket in accordance with the invention, as for example when a strung racket softens with prolonged play and it is desired to stiffen it selectively in accordance with the invention.

The string within the stringing network is threaded through the frame 16 in the conventional manner. The frame 16, as is usual, will have holes through which the string can be threaded. The string is wound along the frame 16 and caused to re-enter the closed area, whenever a string crossing (or an additional strand of a string crossing) is required and is terminated at its ends by wedging it or knotting it at a hole. Less preferably several separate strings can be utilized, using similar termination procedures.

The stringing network 20 comprises a plurality of transverse strings 22 which cross the closed area from one side 24 of the frame 16 to the opposite side 26. Generally vertically oriented (main) string crossings are threaded and interwoven between the transverse (cross) strings or string crossings 22.

It can be seen that the main strings or string crossings are not perpendicular to the transverse strings 22. Instead, the adjacent main strings at the top 28 of the racket have quite close transverse spacing therebetween at the top of the racket, (considerably closer than in a conventionally strung racket) and flare apart from each other toward the bottom of the racket. Thus, for example, adjacent main strings 32 and 34 have a transverse distance therebetween at the frame intersection at the top 28 which is substantially less than the transverse distance between the same two strings 32, 34 where these strings are threaded into the bottom portion 30 of the frame 16. In a preferred embodiment the main string spacing is approximately $\frac{3}{8}''$ at the top of the racket and is approximately 6/8″ at the bottom of the racket.

In other preferred embodiments, especially those having a high reenforcing concentration of cross strings, the overall main string spacing can be enlarged so as to be approximately 7/16″ at the top of the racket and approximately $\frac{7}{8}''$ at the bottom of the racket. If sufficient concentration of reenforcing crosses is provided, top spacing of approximately $\frac{1}{2}''$ and corresponding bottom spacing of approximately 1″ can be utilized.

As indicated in FIG. 1, at the bottom area of the racket, selected ones of the transverse string crossings 36 comprise two individual string sections traversing across the frame through the same frame holes and spiraled about each other. As indicated, the double strings are produced by stringing a single string which is re-entered and traverses through the same pair of holes wherever a double (or triple) strand is required.

Thus, for example, in stringing the pattern of FIG. 1, the long main strings can be installed first using a single string starting from the bottom left and weaving up and down and returning to the bottom right so that the mains are completed and substantial unused left and right string lengths are available at the bottom. One of the unused string lengths is then led downward around the outside of the frame to the proper side starting hole and is then woven back and forth horizontally across the frame to form successive horizontal strings from bottom to top and terminated to complete the primary cross strings. The then remaining unused string length is then used to create the desired double strands by being first led downward around the outside of the frame to the bottommost string side hole through which a single strand has already been installed and at which a double strand is desired, and is entered through that hole and spiraled about the already installed strand and woven across to the opposite side hole to complete a double strand horizontal string crossing through the pair of opposed holes. The same strand is then led around the frame upward and re-entered at the next higher double strand position and is used in the same way to create each of the successively higher horizontal double strand strand string crossings until they are all completed; and the strand is then tied off and terminated to complete the racket stringing.

The above-described procedure for stringing the stringing and double strand pattern of FIG. 1 is only by way of example, as those skilled in the racket stringing art, after receiving the teachings of the present specification, can readily perceive many alternate stringing procedures for obtaining any of the stringing and multiple strand patterns of the invention.

To understand the effect of such double stringing, consider that a single string when it is impacted by the ball acts as a spring of a particular stiffness, which is deflected by the ball and then rebounds to assist in returning the ball. The effect of having two immediately adjacent strings is that such strings act like two springs acting in parallel to share the load of the same ball, so that the effective stiffness of the combination is doubled even though the stiffness and tension of each individual string is unchanged. This allows greater stiffness at the selected areas with the same or even less stringing tension. This in turn allows the overall stringing tension to be relaxed, if desired below the 60–80 pound tensions which professionals often use, while retaining stiffness in the selected areas and allowing expansion of the central sweetspot into marginal areas.

The same parallel spring load sharing principle explains in part the effect achieved by reducing the transverse space between the main strings toward the top of the racket. Specifically, a ball contacting the network 20 toward the upper portion of the racket will slightly compress so as to cover a generally circular contact area on the stringing network, and because of the relatively close spacing between the main strings will actually be in impacting contact with a greater number of main strings than in a conventionally spaced string network, and these strings will act as load sharing springs upon the ball. Thus the strings in the area of concentration at the top of the racket will act in combination much stiffer than otherwise. It should be noted, however, that the concentrated main strings are all long strings and therefore, despite their combinational stiffness, will in ordinary impact areas be sufficiently decoupled from the frame to retain liveliness or lack of deadness. This effect is further increased by having fewer (farther spaced) short cross strings at the top and also bottom of the racket, thus reducing the deadening effect associated with short strings. In effect, the loss of stiffness resulting from the removal of short dead cross strings is compensated for at the top of the racket by the increased stiffness associated with the concentration of lone lively main strings.

At the bottom area of the racket, both the sparcity of short cross strings and the wide spacing of the flaring mains are compensated for by the increased combinational stiffness of the double stranded remaining cross strings which are spaced well above the bottom and are therefore long enough to not contribute unduly to bottom deadness. Thus overall the stringing will play more uniformly well along its length from top to bottom areas. The normal dead area at the top of the racket is greatly reduced, so that the stringing greatly improves power in the tennis serve as performed by ordinary players, who, as before stated, usually serve with ball impact well above the sweetspot and toward the top of the racket. Stiffness and power are preserved or increased at the central areas by the slightly better than normal concentrations of long crossings and the approximately normal concentrations of the flaring mains at this central area. At the bottom, moderate stiffness is preserved by the few remaining but double stranded cross strings.

It is clear also that if the very highest hitting would not only further stiffen the central area but would also contribute to frictional contact with the ball so as to increase applied spin. On the other hand, all double stranded cross strings could be deleted to provide a stringing with a soft bottom area that could be artfully used for soft shots such as lobs and drop shots.

In a preferred embodiment of FIG. 1, the close spacing of the cross strings at the central areas of the racket is substantially 7/16", and the spacing of the cross strings at the top and bottom of the racket is approximately 1".

Figure 2:
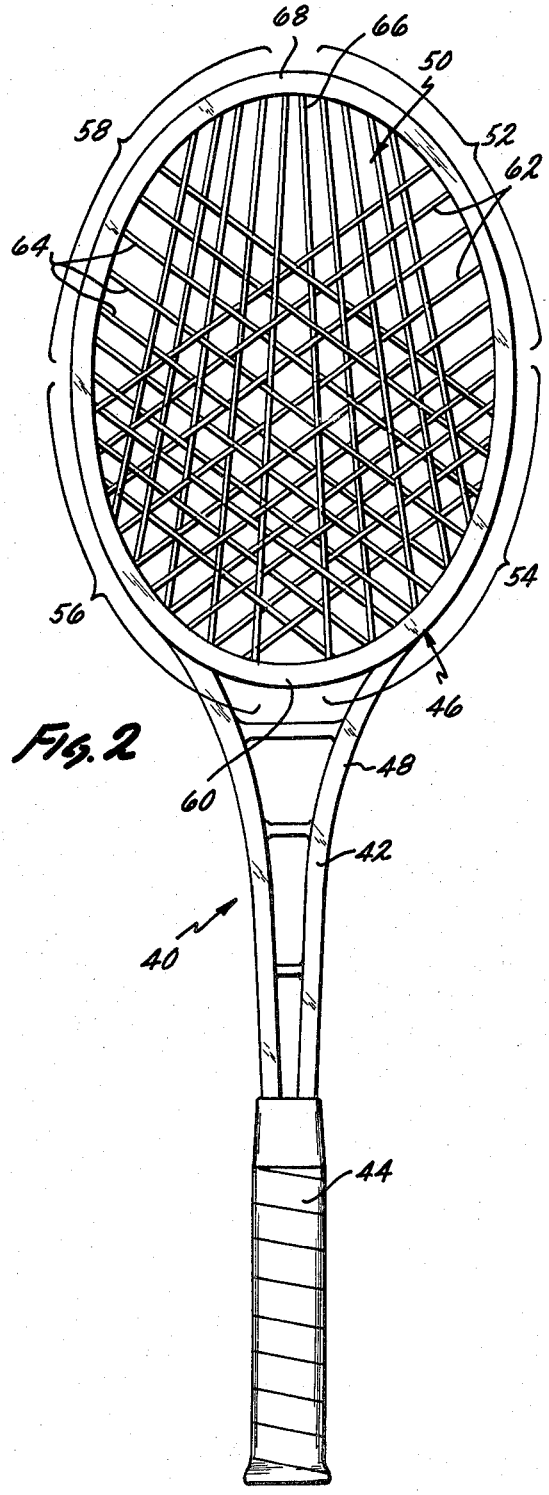
FIG. 2 is an alternative embodiment of the invention as seen in FIG. 1, having additional diagonal strings.

FIG. 2 illustrates an alternative embodiment of the invention employing the generally vertical, top-to-bottom flare stringing of FIG. 1 combined with two sets of diagonal strings.

As shown in FIG. 1, a tennis racket 40 has a handle 42 with a conventional hand grip 44. The handle 42 can be a ribbed handle having two elements connected by braces as shown. In this embodiment as in other embodiments, the handle including the neck connecting the handle to the frame may be interchanged and designed according to the manufacturer's choice and constitute merely the general environment of the invention. Similarly, the frame itself so long as it is strong enough to tension the strings and is holed or otherwise provided with string pivot points to anchor the described stringing patterns, can be provided in various forms as the environment for the stringing patterns of the invention.

As shown in FIG. 2, the handle 42 is connected through a neck 48 to a frame 46. For convenience in describing the stringing network 50, the frame 46 can be considered as generally comprising an upper right hand section 52, a lower right hand section 54, a lower left hand section 56, and an upper left hand section 58. It will be appreciated that these sections on the annular frame 46 may partially overlap each other. The lower left hand and lower right hand sections overlap a bottom section 60 which is connected to the neck 48.

The stringing network 50 consists of a plurality of parallel, diagonally threaded or strung strings 62 which are threaded from the upper right hand section 52 to the lower left hand section 56 of the frame 46. An additional plurality of generally parallel strings 64 cross the closed area within the frame 46 from its upper left hand section 58 to its lower right hand section 54. The strings 64 cross and are interwoven with the diagonal strings 62.

Also crossing and interwoven with both the diagonal sets of strings 62, 64 is the generally vertical set of strings 66 having the flare from the top section 68 to the bottom section 60 of the frame 46. The same advantages as enumerated for the embodiment illustrated in FIG. 1 can be realized in the embodiment of FIG. 2. In the embodiment of FIG. 2, however, there is a greater concentration of strings in the central area of the stringing network 50 and also a greater concentration of strings in the side areas, these giving greater central hitting power and greater accommodation at the sides for the average player who will often hit to one side or the other of the central sweetspot area. It will be noted that all of the greater string concentrations are provided by the relatively long diagonal strings, and there are no very short strings.

Figure 3:
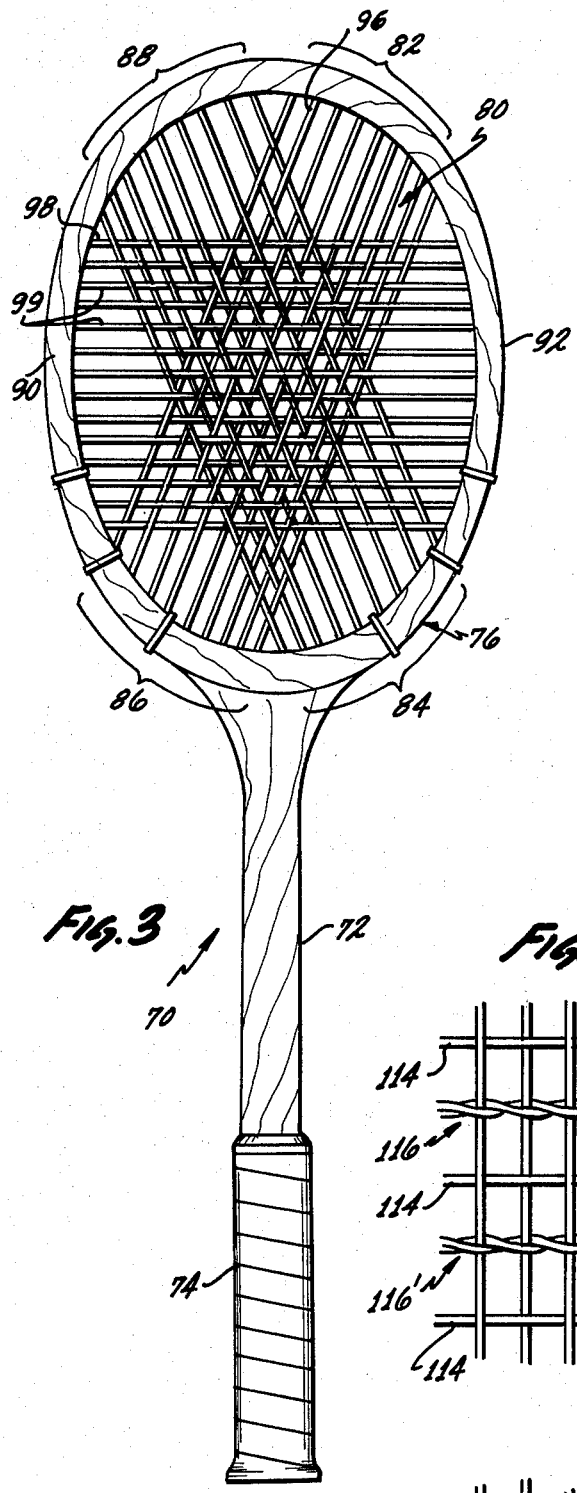
FIG. 3 is yet another alternative embodiment having central string concentrations in a hexagon shaped area and surrounding string concentration in a Star of David shaped area.

Although FIG. 3 does not embody either downwardly flaring strings or multiple strand strings, it does illustrate some relevant principles. In FIG. 3, a racket 70 has a handle 72 and hand grip 74. The handle 72 directly connects with a frame 76 having a generally oval shape. The frame 76 defines an annulus enclosing the area in which a stringing network 80 is threaded.

Again, the frame 76, for convenience in describing the present invention, is thought of as generally comprising an upper right hand section 82, a lower right hand section 84, a lower left hand section 86, and an upper left hand section 88. The neck of the racket 70 connects the handle 72 to the frame 76 between or generally overlapping the lower right hand section 84 and lower left hand section 86. The frame 76 should be considered, further, to have opposing side sections 90, 92. As in the illustration of FIG. 2, these frame sections of the frame 76 should be considered as overlapping their respective adjacent sections.

The stringing network 80 comprises a set or plurality of generally parallel, diagonal string crossings 96 threaded through the frame from the upper right hand section 82 to the lower left hand section 86. A second set or plurality of strings 98 are threaded through the frame 76 from its upper left hand section 88 to its lower right hand section 84. The strings 96 and 98 are interwoven with each other to create a cross diagonal stringing network.

Transversely threaded across the enclosed area within the frame 76 is a third set or plurality of generally parallel strings 100. The strings 100 are interwoven and crossed through the diagonal strings 96, 98. As may be appreciated from the illustration of FIG. 3, the amount of string concentration is greatly increased in a central hexagonal shaped area of the stringing network 80, is less greatly increased in a surrounding star of David shaped area, and is substantially decreased in the still further peripheral areas of the stringing network 80 adjacent the interior edge of the racket frame 76.

The strnging pattern of FIG. 3 will have a very stiff, hard hitting central section extending to lesser extent into the outer Star of David triangular points. However, because of the complete avoidance of short strings, it will have a greatly expanded sweetspot with very good dwell on the racket. The stringing, however, tends to become erratic at the margins, and is, therefore, best utilized by a farily good player who seldom hits at the margins.

Figure 4:
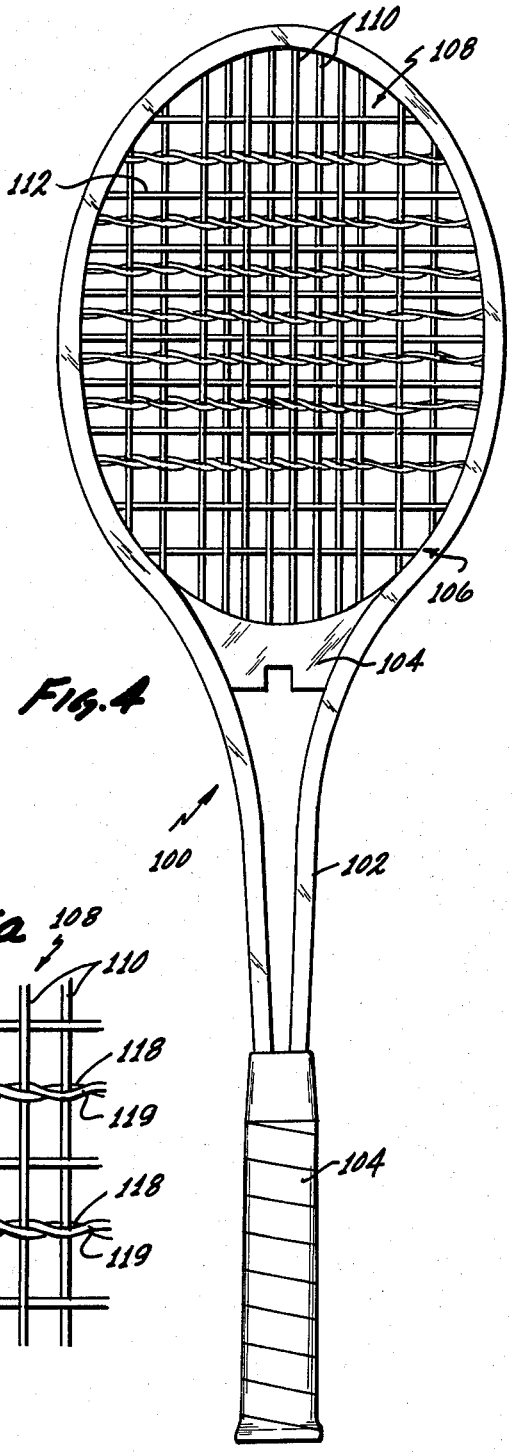
FIG. 4 is a plan view of another aspect of the invention illustrating use of multiple strand reentrant string crossings.

Turning now to FIG. 4, an embodiment of the invention is illustrated which combines a stringing pattern generally similar to that described in U.S. Pat. No. 4,013,289, with multiple strand reentrant strings. The racket 100 has a handle portion 102 with a handle grip 104. In the illustration of FIG. 4, the handle portion 102 is comprised of a metal piece which is monolithic with the major part of the frame portion 106. An insert block 104 is placed within the open neck area of the monolithic handle 102 to complete the frame and thereby complete the definition of the generally oval, closed annulus interior area surrounded by the racket frame. The frame 106 will therefore be considered to include the insert 104. As noted hereinabove, the particular structure of the frame and handle portion is not considered to be material to the enjoyment of the benefits of the present invention. Other shapes of frames and rackets may be used while employing the present invention.

The frame 106 has a stringing network 108. The transverse spacing between the vertical or main strings 110 is reduced in the central of the network area to concentrate strings and is enlarged at the peripheral portions of the enclosed area.

Similarly, the vertical spacing between the cross strings 112 is reduced at the central areas to concentrate strings and is enlarged at the top and bottom areas. The pertinent dimensions of a preferred embodiment are as follows:

In such a preferred embodiment the spacing of the eight central mains from each other is $\frac{3}{8}''$. The spacing therefrom of the next outward main (whether left of right) is approximately $\frac{7}{8}''$, and the spacing therefrom of the final outward main is approximately $\frac{7}{8}''$ so as to have a distance from the frame which, in the conventional size frame, is approximately 1".

Similarly, the approximate spacing from each other of the ten central crosses is $\frac{3}{8}''$, and the successive approximate spacings of the next three top strings (or bottom strings) are respectively 6/8", $\frac{7}{8}''$, and $\frac{7}{8}''$, leaving top and bottom distances from the frame of approximately 1-3/16".

In yet another preferred embodiment having enlarged minimum space of 7/16", the eight central mains have a spacing from each other of 7/16", and the next two outer mains (whether left or right) have successive spacing of $\frac{7}{8}''$ and $\frac{7}{8}''$ respectively, leaving distances from the sides of the frame of approximately $\frac{3}{4}''$.

Similarly, the ten central crosses have spacings from each other of 7/16" and the next three outer crosses (whether top or bottom) have successive spacings of $\frac{7}{8}''$, $\frac{7}{8}''$, and $\frac{7}{8}''$, leaving distances from the top and bottom of the frame of approximately 1-1/16".

In addition, if desired, any of the preferred dimensions of the Kaminstein U.S. Pat. No. 4,013,289 can be utilized.

The stringing network therefore provides all of the advantages of this general type of system having reduced marginal string spacing, and also would, if not further modified, provide its several disadvantages of limited central stiffness and reduced marginal performance.

Figure 5A:
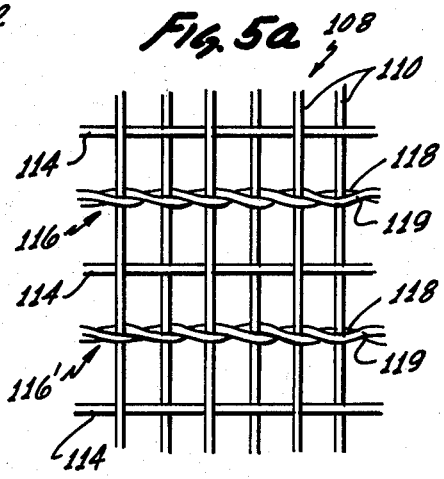
FIG. 5A is an expanded detail of a portion of the view of FIG. 4 as seen within the lines of the insert.

However, as shown in FIG. 4, the stringing network 108 has every other of its central area transverse crossings 112 in the form of double strands contacting each other in a spiral relationship. The particulars of such a double strand arrangement may be seen in FIG. 5A, an expanded detail of the bounded insert taken from the string network 108 of FIG. 4. Individual vertical string crossings 110 comprise a single strand of string as shown. The ordinary transverse crossings may each comprise a single strand, such as strands 114 woven as shown with the vertical strands 110.

Selected ones (every other) of the central transverse crossings, such as crossings 116, comprise dual strands 118 and 119 in contact with each other. Strand 118 is woven with the vertical strings 110. Similarly, the transverse strand 119 is woven with the vertical string 110. The transverse strand 118, however, is spiraled in relation to the strand 119 as both strands are woven about the vertical string 110. The strands 118, 119 of strand crossing 116' are woven in a similar manner, and spiraled similarly in relation to each other.

Figure 5B:
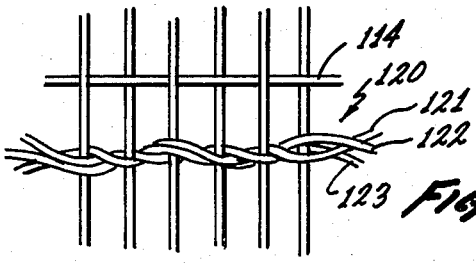
FIG. 5B illustrates an alternative type of multiple strand string crossing which can be employed.

In FIG. 5B, the crossing 120 comprises yet another alternate form of the spiral string crossing of the present invention, having three strands 121, 122 and 123. This triple strand arrangement has two strands 122, 123 spiraled in relation to each other, each individual strand being woven about the vertical string 110. In addition, a strand 121 is woven with the vertical string 110, and spiraled on top of the dual strand 122, 123 arrangement. In such a manner, a triple strand crossing is achieved.

The dual or triple strand concept may be employed in any stringing network arrangement, on vertical crossings, transverse crossings or diagonal crossings as may be desired for special effects. For example, in the embodiment of FIG. 1, the transverse crossings 36 are illustrated as double strand, spiral crossings similar to the spiral crossings 116 of FIG. 5.

As shown in FIG. 4, the spiraled double strand cross strings greatly improve the stiffness of the central hitting area, while allowing reduced string tension which can greatly increase the deadness of the marginal areas, thus greatly enlarging the sweetspot. At the same time the same double cross strings greatly stiffen the side marginal areas with long strings (which are therefore free of deadness). The same double strand spiral cross strings greatly improve frictional contact with the ball for application of controlled spin. The overall improvement of playing performance is really remarkable. In particular, dwell time is greatly increased in a very hard hitting type of racket. Note that the spiral cross strings lock the mains so as to greatly decrease string motion and sawing of the strings upon each other.

The embodiment of FIG. 6 can be considered to have a stringing pattern identical to that of FIG. 5, but with the strands of each double strand string being woven skew or antiparallel as indicated in FIG. 6 and shown in detail in FIG. 7A.

As shown in FIG. 6, the racket 120 comprises the usual handle 122 and hand grip 124. A frame 126 forms an annular, closed area in which a string network 128 is threaded. The network 128 comprises vertical, substantially parallel strings 130 and transverse crossings 132.

FIG. 7A illustrates in expanded detail a portion of the network 128 bounded by the insert border shown in FIG. 6. In particular, the network 128 comprises vertical crossing strings 130 and alternate transverse crossings 132 and 133. Each crossing 132 comprises at least two antiparallel strands 134 and 136. Each of the strands 134 and 136 are woven through the vertical crossings 130. The strand 134, however, is woven oppositely from the weave of strand 136, so that when strand 134 is threaded about one of vertical strings 130, its complemental strand 136 is woven on the other side of the same string 130.

As shown in FIG. 7A, the strands 134, 136 are directly adjacent each other. The double strands are driven towards each other for reasons which are explained below and they may or may not be in contact with each other, but will be driven very closely adjacent to each other.

It should be understood, however, that if desired, the double strands can be woven so as to bow away from each other, seeking spaced hollows on the mains in which to rest as shown in FIGS. 7B and 7C.

FIG. 7B illustrates an alternate form of antiparallel double strand string crossings **132*b*, each consisting of a lower straight strand 136*b* and an antiparallel upper bowed strand 134*b* which bows away from its own complemental strand 136*b* and towards the upwardly next adjacent straight strand 136*b***.

FIG. 7C illustrates still another form of antiparallel double strand string crossings **132*c* which as shown in FIG. 7C are alternated with conventional single strand crossings 133*c*. Each of the double strand string crossings 132*c* consists of a top strand 134*c* and a complemental antiparallel bottom strand 136*c* which bow away from each other (with the top strand 134*c* bowing upwardly toward the upwardly next adjacent straight string 133*c*, and the bottom strand 136*c* bowing downwardly toward the downwardly next adjacent straight string 133*c***.

In order to understand the behavior of the antiparallel double strings which bow in different fashions in FIGS. 7B and 7C and are unbowed in FIG. 7A, it is necessary to observe carefully the different weaving patterns which are used in these figures.

Considering first FIG. 7B, it can be assumed that all of the straight strings **136*b* are woven first with the normal alternative weave of successive cross strings, the top straight string having a particular weave which is designated as the plus (+) weave, the next lower straight string having an opposite weave designated minus (−), and the next two lower strings continuing the alternation with + and − weaves respectively. The straight horizontal strings with their alternating weaves of course bind the vertical strings 130** into corresponding corrugations of alternating hills and hollows as viewed from the front of the racket. Note, however, that each cross string isat every crossing positioned in a hollow which it has formed and which is its most stable and preferred position. If a cross string were forced momentarily to slide away from its hollow, its tension would drive the string to return it to its hollow.

After the straight horizontal cross strings **136*b* are woven as shown, the bowed cross strings 134*b* are woven at a slightly relaxed tension (which will permit the bowing). Each of the bowed strings is woven with a weave (+ or −) which is opposite to the weave of its complemental strand but is the same as the weave of its upwardly adjacent straight strand. Because of its weave, each bowed strand 134*b*** is forced away from its oppositely woven antiparallel companion strand (it cannot stay with its companion strand because it would be resting unstably on a series of hills) and is driven by its tension toward the upwardly adjacent matching weave straight strand to attempt to lie in the hollows created by that matching weave strand. Thus a + weave bowed strand is attached and bowed, towards an upwardly adjacent + weave straight strand; and similarly a − weave bowed strand is bowed towards the upwardly adjacent − weave straight strand.

It should be noted that the bowed strings, because of their extra length and somewhat relaxed tension, have marked decoupling from the frame and can be used to introduce reinforcement with little or no detriment to sweetspot performance.

With the understand gained from consideration of FIG. 7B, the reader can readily understand the functioning of the bowed strings in FIGS. 7A and 7C. As shown in FIG. 7C, each of the upper strands 134C has the same weave sign (+ or −) as the upwardly adjacent straight strand 133C, and is therefore bowed upwards thereto, while at the same time each of the lower strands **136*c* has the same weave sign (+ or −) as the downwardly adjacent straight strand 133*c* and is therefore bowed downward thereto. Overall the double strand compressing 134*b* and 136*b*** are bowed outwards away from each other as shown.

Referring to FIG. 7A, assume that the straight single strands 133 are woven first and the double strands thereafter. Note that in each double strand 132 the upper strand 134 has a weave sign (+ or −) which would attract it to the same signed lower adjacent straight strand 133; and the corresponding lower strand 136 has a weave sign (+ or −) which would attract it to the corresponding same signed upper adjacent single strand 133. Thus overall in each double strand, the upper strand is being driven downward and the lower strand is being driven upward with the result that the two strands are driven towards each other and block or oppose each other, and are therefore not bowed but lie together as contiguous or adjacent double strands. Increasing stringing tension tends to drive them together into contiguousness while relaxing stringing tension permits them to assume merely adjacent positions.

In FIG. 8, yet another alternative form of double strand usable in the invention is illustrated in detail. Again, vertical string crossings 142 are woven by alternate transverse string crossings 144. Each transverse crossing 144 comprises two strands 146 and 148. The adjacent strands 146, 148 are parallel to each other in all respects, passing on the same side of each vertical string 142 as its adjacent, complemental strand 148. The strands 146, 148 in each crossing 144 are directly adjacent each other and normally in close contact with each other.

It should be noted that all of the double stringings tend to lock the strings through which they are woven more securely and prevent destructive sawing action. This is especially true of the multiple string embodiments of FIGS. 5A, 5B and 7A.

The described reduction of the distance between adjacent string crossings, and the double stringing concept described hereinabove, has the effect of increasing the sharpness of the bends which an individual string makes as it is woven and crossed over or under a perpendicularly disposed string. It also forces the perpendicularly disposed strings into sharper bends. The practical result is that the surface of the stringing network is more rough as perceived by the ball. The string network, therefore, has much greater frictional contact with the ball because it (1) provides more string surface per contact area, (2) has a rougher surface because of the sharper bends of the strings, and (3) has a rougher surface because of the corrugations of the double strands. Players therefore can exercise much better control of the spin of the ball, when stroking the ball. Topspins, underspins and other spins as desired can be much more effectively applied.

In the embodiments thus far shown and described in the present specification, the transverse double or multiple strand threading has been emphasized. Of course, the double or multiple strand string crossings may be placed along the mains (or the diagonal crossings), as shown in FIGS. 9A, 9B and 9C, with corresponding advantages, especially in strengthening the serve.

Both double stranding of the mains and double stranding of the cross strings contribute to greater frictional contact and better spin control. It is believed that either can be predominantly effective depending upon the stroking patterns of a particular player. In applying spin, the ball rolls slightly along the racket in a direction which is determined by the player's stroke (whether the player hits "straight ahead" and "up on the ball"; or "roundhouse" or "pulling the racket"; or combinations thereof).

The ball accordingly will roll transversely or diagonally on the racket. (In an underspin overhead it even rolls upwards). Spin will best be applied if one set of strings act as high friction rails on which the ball rolls, and the other set of strings acts as high friction crossbars which stroke the ball to increase its roll or spin. Most players tend to hit up and fairly straight ahead and will,, therefore, profit from either vertical or horizontal double strand crossings or both to apply high top spin.

The foregoing detailed description is illustrious of several embodiments of the invention, and it is to be understood that additional embodiments thereof will be obvious to those skilled in the art. The embodiments described herein, together with those additional embodiments, are considered to be within the scope of the invention.

What is claimed is:

1. A racket having an improved stringing network, said racket comprising:

a frame enclosing an annular opening and having a handle extending longitudinally from the bottom thereof;

a first plurality of generally aligned main string crossings traversing the frame from top to bottom thereof in a generally longitudinal direction and consisting of all of the main string crossings of the racket, the said main string crossings having relatively close spacing to each other at the top of the frame and continuously flaring away from each other with increasing spacing therebetween as they traverse across the frame opening to the bottom of the frame;

a second plurality of generally aligned string crossings traversing across the frame opening from one portion of the frame to an oppositely disposed portion of the frame, making large angles near 90 degrees with the first plurality of string crossings, and being woven through the first plurality of string crossings.

2. The racket of claim 1 wherein the second plurality of string crossings are generally lateral string crossings traversing across the frame opening from one side of the frame to the opposite side of the frame, and are spaced further apart near the top of the annular opening than at the middle.

3. The racket of claim 1 wherein some of the second plurality of string crossings are plural strand string crossings, all of said plural strand string crossings being located closer to the bottom of the racket opening than the top, each comprising a pair of adjacent individual strings which at each end thereof enter the frame opening together through the common frame apertures.

4. The racket of claim 3 wherein in each of the plural strand string crossings, one of the pair of strings is wound in a spiral about the other of the pair of strings.

5. A racket having an improved stringing network, said racket comprising:

a frame enclosing an annular opening and having a handle extending longitudinally from a bottom end thereof;

a first plurality of generally aligned main string crossings traversing the frame opening in a generally longitudinal direction from the top of the frame to the bottom of the frame;

a second plurality of generally aligned generally lateral string crossings traversing the frame opening from one side of the frame to the opposite side of the frame and weaving through the first plurality of string crossings;

said first plurality of generally aligned main string crossings consisting of successively adjacent string crossings in which the three outermost string crossings on each side have relatively large spacing from each other and the remaining, central, string crossings have substantially smaller spacing from each other, the outermost string crossings on each side having relatively large spacing from the frame side to thereby have only relatively long main strings and decrease coupling of the stringing network to the frame;

a predetermined plurality of the second plurality of lateral string crossings being relatively long plural strand string crossings traversing across the central region of the frame opening to stiffen the central region and to thereby greatly reinforce the widely spaced outer mains with relatively long plural strand string crossings.

6. A racket having an improved stringing network, said racket comprising:

a frame enclosing an annular opening and having a handle extending longitudinally from a bottom end thereof;

a first plurality of generally aligned string crossings traversing the frame opening from a first section of the frame to an opposite second section of the frame;

a second plurality of generally aligned string crossings traversing the frame opening from a third section of the frame to an opposite fourth section of the frame, said second plurality of string crossings making large angles near 90° with the first plurality of the string crossings and weaving through the first plurality of string crossings;

said second plurality of string crossings including first, second and third successive adjacent string crossings, said first and third string crossings being generally aligned straight single strand string crossings having respectively opposite weave senses through the first plurality of string crossings, said second string crossing being a plural strand string crossing comprising a pair of adjacent strings 2a and 2b, respectively, having opposite weave sense to each other and entering and leaving the frame opening together through common frame apertures, string 2a being positioned between the first string crossing and string 2b, and string 2b being positioned between string 2a and the third string crossing.

7. A racket having improved stringing network, said racket comprising:

a frame enclosing an annular opening and having a handle extending longitudinally from a bottom end thereof;

a first plurality of generally aligned string crossings traversing the frame opening from a first section of the frame to an opposite second section of the frame;

a second plurality of generally aligned string crossings traversing the frame opening from a third section of the frame to an opposite fourth section of the frame, said second plurality of generally aligned string crossings making large angles near 90° with the first plurality of string crossings and weaving through the first plurality of string crossings;

said second plurality of generally aligned string crossings including a first straight string crossing and a successively adjacent second string crossing, said second string crossing being a plural strand string crossing comprising a pair of adjacent strings 2a and 2b respectively having opposite weave sense to each other and entering and leaving the frame opening together through common frame apertures, string 2b being straight and string 2a being positioned between the first string crossing and string 2b and being bowed away from string 2b and towards said first string crossing, string 2a having the same weave sense as the first string crossing and string 2b having the opposite weave sense thereto.

8. A acket having an improved stringing network, said racket comprising:

a frame enclosing an annular opening and having a handle extending longitudinally from a bottom end thereof;

a first plurality of generally aligned main string crossings traversing the frame opening in a generally longitudinal direction from the top of the frame to the bottom of the frame;

a second plurality of generally aligned generally lateral string crossings traversing the frame opening from one side of the frame to the opposite of the frame and weaving through the first plurality of string crossings;

said first plurality of generally aligned main string crossings consisting of successively adjacent string crossings in which the three outermost string crossings on each side have relatively large spacing from each other and the remaining, central, string crossings have substantially smaller spacing from each other, the outermost string crossings on each side having relatively large spacing from the frame side to thereby have only relatively large spacing from the frame side to thereby have only relatively long main strings and decrease coupling of the stringing network to the frame;

a predetermined plurality of the second plurality of lateral string crossings being relatively long plural strand string crossings traversing across the central region of the frame opening to stiffen the central region and to thereby greatly reinforce the widely spaced outer mains with relatively long plural strand string crossings;

at least one of the plural strand lateral string crossings being positioned directly adjacently between first and second straight lateral string crossings having respectively opposite + and − weaves through the mains, said one plural strand lateral string comprising a pair of adjacent third and fourth strings entering and leaving the frame opening together through common frame apertures, the said third and fourth strings being bowed apart from each other towards respectively the said first and second string crossings, and said third string having the same + weave as the first string crossing and said fourth string having the same − weave as the second string crossing, whereby both strings of the pair are bowed outward towards immediately adjacent like weave string crossings.

9. A racket having an improved stringing network said racket comprising:

a frame enclosing an annular opening and having a handle extending longitudinally from a bottom end thereof;

a first plurality of generally aligned main string crossings traversing the frame opening in a generally longitudinal direction from the top of the frame to the bottom of the frame;

a second plurality of generally aligned generally lateral string crossings traversing the frame opening from one side of the frame to the opposite side of the frame and weaving through the first plurality of string crossings;

said first plurality of generally aligned main string crossings consisting of successively adjacent string crossings in which the three outermost string crossings on each side have relatively large spacing from each other and the remaining, central, string crossings have substantially smaller spacing from each other, the outermost string crossings on each side having relatively large spacing from the frame side to thereby have only relatively long main strings and decrease coupling of the stringing network to the frame;

a predetermined plurality of the second plurality of lateral string crossings being relatively long plural strand string crossings traversing across the central region of the frame opening to stiffen the central region and to thereby greatly reinforce the widely spaced outer mains with relatively long plural strand string crossings;

at least a first one of the plural strand string crossings being positioned immediately adjacent a first straight lateral string crossing, said first plural strand string crossing comprising a pair of adjacent second and third strings which enter and leave the frame together at common frame apertures, said third string being straight and said second string being positioned between said third string and said first string crossing and being bowed away from said third string and toward said first string crossing, said second string having a weave sense which is the same as the weave sense of the first string crossing and is opposite to the weave sense of the third string.

10. The racket of claim 9 wherein a second plural strand string crossing is positioned immediately adjacent said first plural strand string crossing and comprises a pair of fourth and fifth strings which enter and leave the frame opening together at common frame apertures, said fifth string being straight and said fourth string being positioned between said fifth string and said third string and being bowed away from said fifth string and towards said third string and having a weave sense which is the same as the weave sense of the third string and opposite to the weave sense of the said fifth string.

11. A racket having improved stringing network, said racket comprising:

a frame enclosing an annular opening and having a handle extending longitudinally from a bottom end thereof;

a first plurality of generally aligned string crossings traversing the frame opening from a first section of the frame to an opposite second section of the frame;

a second plurality of generally aligned string crossings traversing the frame opening from a third section of the frame to an opposite fourth section of the frame, said second plurality of generally aligned string crossings making large angles near 90° with the first plurality of string crossings and weaving through the first plurality of string crossings;

said second plurality of generally aligned string crossings including a first straight string crossing and a successively adjacent second string crossing, said second string crossing being a plural strand string crossing comprising a pair of adjacent strings **2*a* and 2*b* respectively having opposite weave sense to each other and entering and leaving the frame opening together through common frame apertures, string 2*b* being straight and string 2*a* being positioned between the first string crossing and string 2*b* and being bowed away from string 2*b* and towards said first string crossing, string 2*a* having the same weave sense as the first string crossing and string 2*b*** having the opposite weave sense thereto;

said second plurality of aligned string crossings further including a third string crossing which is successively adjacent to said first and second string crossings, said third string crossing being a plural strand string crossing comprising a pair of adjacent strings **3*a* and 3*b* respectively having opposite weave sense to each other and entering and leaving the frame opening together through common frame apertures, string 3*b* being straight and string 3*a* being positioned between string 2*b* and string 3I b, said string 3*b* having opposite weave sense from the weave sense of string 2*b* and string 3*a* having the same weave sense as string 2*b*, string 3*a* being bowed away from string 3*b* and bowed towards string 2*b*, whereby strings 2*a* and 3*a* are bowed outwards in the same direction, each being bowed away from its corresponding paired string 2*b* and 3*b*** respectively.

* * * * *